United States Patent [19]

Leive

[11] 4,112,248

[45] Sep. 5, 1978

[54] TERMINAL BOX FOR A LIFTING MAGNET

[75] Inventor: Ernest W. Leive, Wauwatosa, Wis.

[73] Assignee: Square D Company, Milwaukee, Wis.

[21] Appl. No.: 735,928

[22] Filed: Oct. 27, 1976

[51] Int. Cl.[2] ..... H01F 7/06

[52] U.S. Cl. ..... 174/50; 335/294

[58] Field of Search ..... 174/65 R, 52 R, 50; 335/292, 294, 290, 291, 289

[56] References Cited

U.S. PATENT DOCUMENTS

| | | | |
|---|---|---|---|
| 2,160,019 | 5/1939 | Hodgson | 335/292 |
| 2,476,049 | 7/1949 | Leitch | 335/292 |
| 2,837,702 | 6/1958 | Blind | 335/291 |
| 3,621,423 | 11/1971 | Swope | 335/292 X |
| 3,763,453 | 10/1973 | Schurr | 335/294 X |

*Primary Examiner*—J. V. Truhe
*Assistant Examiner*—D. A. Tone
*Attorney, Agent, or Firm*—William H. Schmeling; Richard T. Guttman

[57] ABSTRACT

A terminal box for a lifting magnet has a bottom mounting surface to be secured to the casing of the lifting magnet over a pair of apertures in the casing through which the coil conductor leads pass. An arcuate protective shield of the box extends upwardly from the outer edge of its bottom surface adjacent to the outer edge of the magnet casing and from the side edges of the bottom mounting surface. The protective shield slants inwardly from the outer edge of the magnet as it extends upwardly from its base. A winged housing of the box has a top surface recessed below the upper edge of the shield. Internally, the housing is divided by a walled divider in the shape of an "H" into individually sealable chambers two of which are in communication with openings in the bottom mounting surface. The openings in the bottom mounting surface are spaced to correspond to the apertures in the casing. The housing has conductor lead passages through the dividing walls of the walled divider so that the individually sealed chambers are in communication with one another and has at least one conductor lead passage to provide access to the outside of the housing for receiving the service leads.

17 Claims, 4 Drawing Figures

TERMINAL BOX FOR A LIFTING MAGNET

BACKGROUND OF THE INVENTION

This invention relates to improvements in lifting magnets and, more particularly, to an improved terminal box for lifting magnets which is adapted to be secured onto the casing of magnets of various sizes and shapes.

Prior terminal boxes for lifting magnets have various shapes and configurations to facilitate the connection between the coil leads and the service leads and also to provide a moisture proof environment for such connections. In order to provide access into the box for making the connections, different types of cover plates are used. These cover plates are usually held on by bolts having heads extending above the cover plates. The plates, which are on the top portion of the terminal box housing, often extend over a portion or all of the top surface of the terminal box.

Typically, lifting magnets are subjected to severe abuse when used as a ram or a drop ball resulting in blows on the front, sides and top of the terminal box. Even under normal use, a magnet terminal box often receives hard direct blows. If a terminal box is of a style with wings, the wings are easily bent up by such blows. To prevent this bending of the winged portions of terminal boxes often requires the addition of long anchor bolts or the like within each wing in order to strengthen the wings against blows. Countersunk holes are often used in an attempt to protect the cover plate bolt heads from blows, but the material around the holes is simply peened in, which prevents the removal of the cover plate. Cover plate bolts are often sheared off, which results in the cover plates being partially or completely knocked off, permitting moisture to enter the terminal box cavity causing the magnet coil to ground to the case.

In addition, the corners of magnet terminal boxes are often badly dented and the sides slightly displaced by the different blows that the terminal box receives in operation. As a result, the internal electrical connections suffer mechanical damage or the water-tightness is lost.

SUMMARY OF THE INVENTION

With this invention, the foregoing problems are substantially solved. The improved terminal box has a protective barrier along its exposed sides. The protective barrier or shield, which is an integral part of the terminal box, is arcuate along its midportion to form a convex outer surface and slants inwardly from the outer edge of the lifting magnet so that blows directed at the terminal box are more likely to glance off without damage. A top and rear wall portion of the housing of the terminal box has its upper surface recessed below the upper edge of the shield and extends inwardly of the magnet from the concave side of the shield. A cover plate, for gaining access to the service leads, fits into a cavity which is sunk below the upper surfaces of the top and rear wall of the housing. The heads of the cover plate bolts are not in countersunk holes. Instead, the bolts are protected by the shield extending along the front and sides of the terminal box housing. The top wall of the housing has openings for gaining access to coil lead chambers within the housing. Tapered, threaded pipe plugs are used for covers of these openings, as such plugs cannot be knocked off when sealed to prevent water from entering the chambers.

To provide a watertight seal between a service lead cavity in the central portion of the housing and coil lead chambers in the wings of the housing, elastomer insulator bushings preferably of Sylgard 170 A&B, made by Dow Corning, are inserted in the respective conductor lead passages between the lead cavity and the chambers and each receive a threaded copper terminal stud. These silicone rubber bushings overcome the problems previously associated with securing terminal studs in the conductor lead passages. Prior polyglass bushings have a tendency to crack when securing the terminal studs to the walls by tightening nuts against them.

The sealing properties of the silicone elastomer against rough surfaces eliminates any requirement for machining either or both sides of the walls between the coil lead chambers and the service lead cavity. These previously had to be machined when using other types of insulator bushings, and therefore, substantial savings in labor costs are provided.

Further, a high temperature nylon gland nut is positioned around the coil leads in the coil lead chamber to isolate the coil lead chamber of the terminal box from the magnet case, and permits the coil leads to be bent during connection of the leads to the terminal studs with no risk of the gland nut cutting through the coil lead insulation thereby to permit a grounding of the coil leads.

BRIEF DESCRIPTION OF THE DRAWINGS

Other objects and advantages will become apparent from the description wherein reference is made to the accompanying drawings illustrating the preferred embodiment of the invention, and in which.

DESCRIPTION OF THE PREFERRED EMBODIMENT

Figure 1:
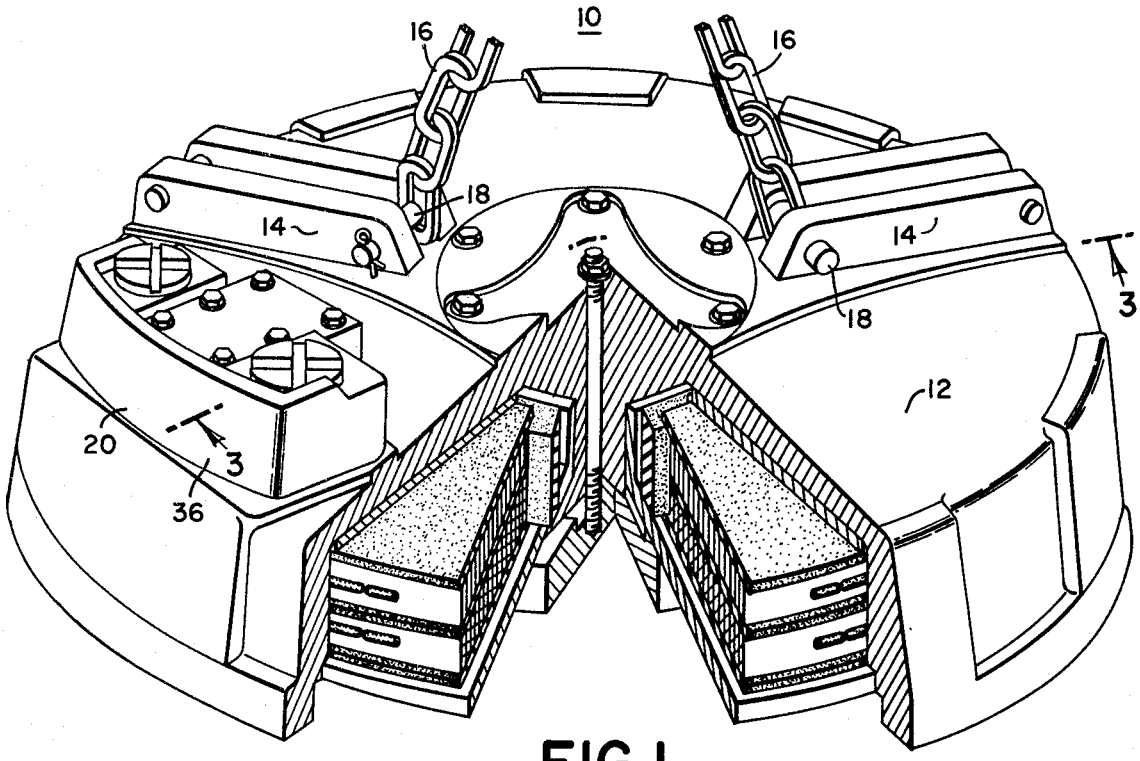
FIG. 1 is a partially sectioned perspective view of a lifting magnet incorporating a terminal box in accordance with this invention.
Figure 2:
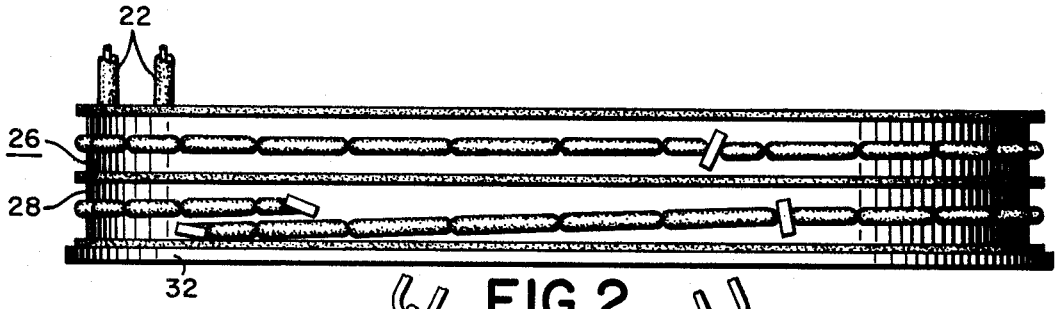
FIG. 2 is a side view of the magnet coil assembly used in the magnet shown in FIG. 1.

One embodiment of an improved terminal box for lifting magnets according to this invention is illustrated in the drawings in connection with a circular lifting magnet 10 having a steel magnet case 12 provided with lugs 14 for attachment of hoisting chains 16 by means of pins 18. The terminal box, shown at 20 and to be described in greater detail later, is formed of cast steel and is welded to the magnet case 12. It facilitates the electrical connection of coil leads 22 to service leads 24 associated with a power source (not shown).

Figure 3:
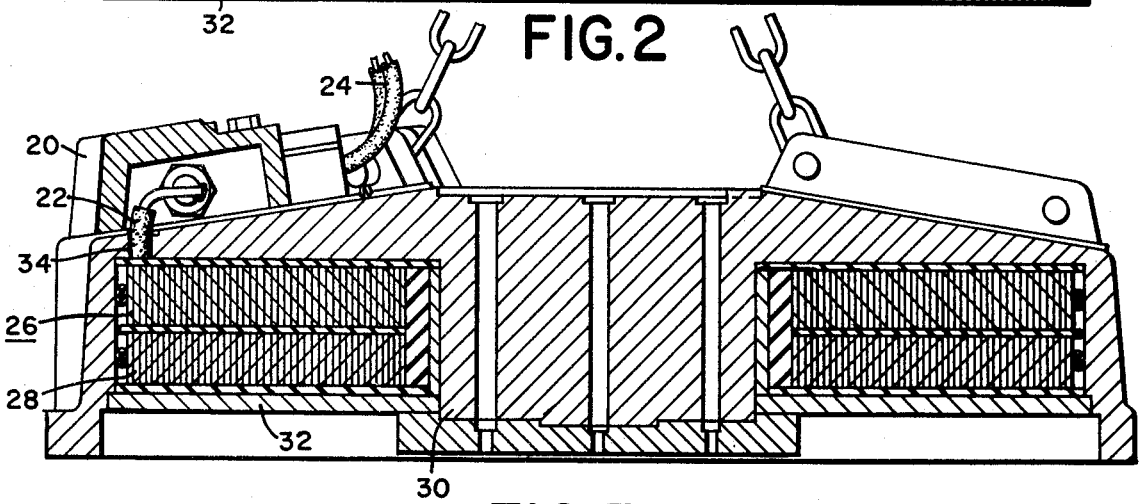
FIG. 3 is a cross-sectional view taken along the lines 3—3 of FIG. 1; and, FIG. 4 is an exploded perspective view of a terminal box in accordance with this invention.
Figure 4:
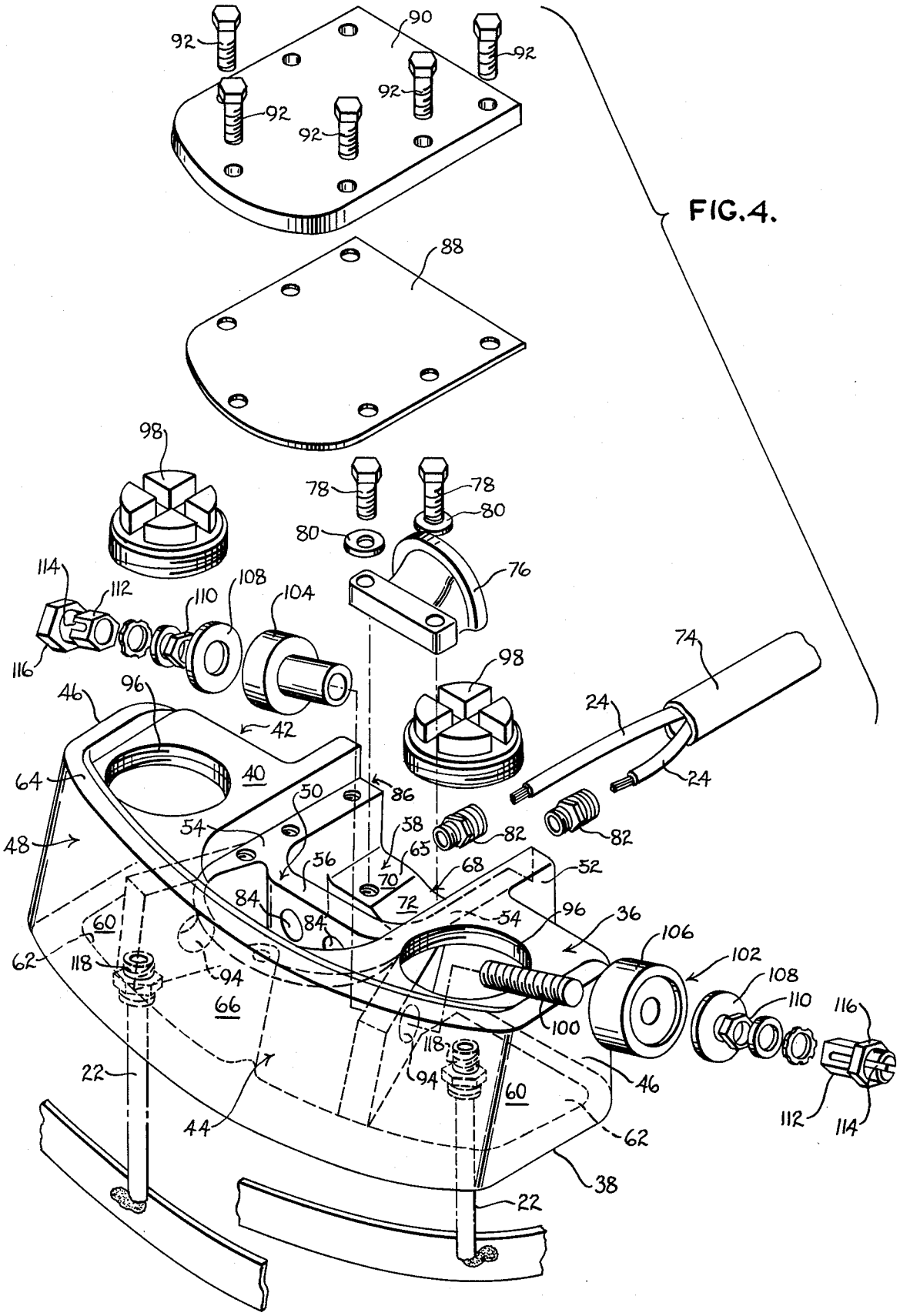

As shown in FIG. 3, within the case 12 is a magnet coil assembly 26 comprising a plurality of coils 28 of copper or aluminum strips of a predetermined width wound in a flatwise stacked relation on a hub portion 30 of a manganese steel bottom plate 32 of the magnet 10. The coils 28 are preferably serially electrically connected to each other and at electrically opposite ends are connected to the coil leads 22 which pass through a pair of spaced apertures 34 in the top of the magnet case 12.

The terminal box 20 is integrally cast out of steel and comprises a mushroom shaped housing 36, a top wall or surface 40, a rear wall 42, and an arcuate front wall 44 and side walls 46 both defining a protective shield 48 generally in the shape of a wing chair. The terminal box 20 further includes a walled divider 50 in the general shape of an "H" which is located centrally within the housing and extends from the front wall 44 to a point just beyond the rear wall 42 to complete the stem 52 of the mushroom shaped housing 36. The walled divider 50 comprises a pair of spaced-apart walls 54 and a wall 56 joining the midportions of walls 54 together to form the "H" shape. The walled divider 50 divides the housing 36 into three individually sealable chambers, a two part central chamber 58 defined by the walls 54, 56, 40, 42, and 44 and a pair of coil lead chambers 60 defined by the walls 54, 40, 42, 44 and 46, one in each wing of the housing 36 on either side of the central chamber 58, to be described in greater detail later.

A bottom mounting surface 38 defined by the walls includes openings 62, two of which are spaced laterally apart from one another for alignment with the apertures 34 through the magnet case 12. The terminal box 20 is secured to the magnet case 12 by welding the housing 36 to the magnet case 12 so that the apertures 34 on the case 12 are respectively aligned with two of the openings 62 in the mounting surface 38, with the front wall 44 closely adjacent to the outer edge of the case 12.

The protective shield 48 defined by the arcuate front wall 44 and the side walls 46 extends upwardly from their bottom surfaces with the front wall 44 adjacent to the outer edge of the magnet case 12. The arcuate front wall 44 of the shield 48 slants inwardly from the outer edge of the magnet case 12 as it extends upwardly beyond the top wall 40 of housing 36 and the side walls 46 of the protective shield 48 slant inwardly toward each other as they too extend upwardly to coincide with the height of the front wall 44. The combination of the front wall 44 being shaped in an arc and slanting inwardly like the opposing side walls 46 will tend to cause any object which hits the protective shield 48 to glance off without damage to the terminal box 20. The combination of the arc and slant prevents a hard, direct blow against the front or sides of the terminal box. In addition, the front and side walls of the protective shield 48 preferably are cast thicker than the remaining walls of the housing 36 with the thickness preferably tapered from wide to narrow in a direction away from their bottom edges.

The top wall 40 and rear wall 42 of the mushroom shaped housing 36 are recessed below an upper edge 64 of the protective shield 48. The top wall 40 extends laterally outwardly from the concave side of the protective shield 48 to form the ceiling for the above mentioned chambers 58 and 60.

Chamber 58 is a service lead entrance to the terminal box 20 which is divided into two cavities, one cavity 65 that is open to the outside atmosphere and a second cavity 66 that is in communication with cavity 65 and sealable therefrom. Cavity 65 includes a service lead cable mount 68 having a base portion 70 with an arcuate groove 72 to receive a cable shield 74 around the service leads 24. A clamp 76 fits over the top of the cable shield 74 and is secured to base portion 70 of the cable mount 68 by means of bolts 78 and lock washers 80. Gland nuts 82 seal around service leads 24 and threadedly engage a pair of conductor lead passages 84 through wall 56 which divides the central chamber 58 into the service lead cavities 65 and 66. The gland nuts 82 provide a watertight seal between service lead cavities 65 and 66. Access is gained to both service lead cavities of the central chamber 58 through a U-shaped opening 86 which is recessed below the top wall 40 of the housing 36 so that when a corresponding U-shaped sealing gasket 88 and a U-shaped cover plate 90 are secured in place over the openings by bolts 92, the top surface of the cover plate 90 is slightly below the top wall 40 of the housing 36. As a result, the heads of the bolts 92 are positioned behind and below the protective shield 48 so that they are unable to be peened in or sheared off by hard blows to the terminal box.

Cavity 66 is in communication with the coil lead chamber 60, one in each wing of the housing on either side of the central chamber 58. Between the service lead cavity 66 and the coil lead chamber 60 are the walls 54 of the walled divider 50 with a conductor lead passage 94 through each wall 54. Access to each of the coil lead chambers 60 is gained through circular threaded openings 96 on the top wall 40 of housing 36. The openings 96 are preferably four inches in diameter and are covered by standard tapered threaded pipe plugs 98 which seal to prevent water from entering the coil lead chambers 60. The top portion of the pipe plugs 98 are also below the upper edge 64 of the protective shield 48 to prevent them from being damaged by a hard direct blow.

A threaded copper terminal stud 100 electrically connects the service leads 24 to the coil leads 22 by having one stud 100 extending through each of the conductor lead passages 94 in each wall 54. The terminal stud 100 is positioned within a two-piece bushing 102 having a male portion 104 on one side of the wall 54 extending through the conductor lead passage 94 to be received in a female portion 106 on the other side of the wall 54. This bushing 102 is made of a desirable elastomer, such as Sylgard 170 A & B made by Dow Corning. Bushing 102 serves as an insulator between the wall 54 and terminal stud 100 which is securely fastened in place by a washer 108 and securing nut 110, one of each on each side of the wall 54. Since the bushing 102 is made out of a silicone rubber, it prevents the inadvertent cracking experienced with the previous polyglass insulators when tightening the securing nut 110 to hold the terminal stud 100 in place on the wall 54. The silicone rubber bushing also effects a good seal against wall 54 without the requirement of machining wall 54 first.

To connect the service and coil leads to the terminal stud 100, a wire terminating fastening means 112 with internal threads is threaded onto each end of the terminal stud 100. The fastening means further includes a slotted portion 114 for receiving the bared wire ends from the service 24 and the coil 22 leads therein with an adjustable nut 116 to clamp the wire ends in the slotted portion 114.

To provide a watertight seal between the coil lead chambers 60 and the interior of the magnet case 12, a high temperature nylon gland nut 118 or the like is threadably engaged into each aperture 34 in the magnet case. The gland nut 118 extends upwardly into the coil lead chamber 60 of the terminal box around the coil lead 22. The nylon gland nut permits the coil lead to be bent when it is attached to the wire terminating fastening means 112 during servicing of the magnet terminal box without inadvertently cutting through the insulation around the coil lead 22 which could cause grounding of the coil lead against the magnet case 12.

After the terminal studs 100 are locked in place in wall 54 and the service and coil leads are attached thereto, a suitable potting compound or the like is poured through the openings 86 and 96 into the coil lead chambers and the second service lead cavity 66 of the central chamber 58. Then the pipe plugs 98 are secured in place as well as the U-shaped cover plate 90 over the coil lead chambers and central chamber, respectively.

The above described terminal box 20 resembles the cross-section of a mushroom with the protective barrier or shield 48 forming the outer cap portion and the housing 36 forming the remainder of the head and stem.

Thus, the problem of damage to the covers for the service lead cavity and the coil lead chambers as well as to the terminal box itself is eliminated by the protective barrier extending along the terminal box housing so that blows to the terminal box glance off rather than causing damage to the terminal box. The silicone rubber insulator bushing in the conductor lead passage between the service lead cavity and the coil lead chambers permits the terminal stud to be secured tightly in place unlike the previous polyglass insulator bushings, which have a tendency to crack when the terminal stud was secured in place by excessive tightening of the locking nuts. Furthermore, the high temperature nylon gland nut prevents the inadvertent grounding out of the coil leads when bending them for connection with the terminal studs in coil lead chambers.

Having thus described the invention, I claim:

1. A terminal box for a lifting magnet, comprising: an arcuate front wall slanting inwardly from the outer edge of its bottom surface as it extends upwardly therefrom; a pair of opposing side walls connected to the bottom surface of the front wall and to the ends of the front wall, said side walls extending upwardly from their bottom surfaces to the same height as the front wall and slanting inwardly towards one another as they extend upwardly from their bottom surfaces, said arcuate front wall and said side walls defining a protective shield; a top wall recessed below the upper edge of the protective shield and extending laterally outwardly from the concave side of the protective shield; a rear wall connected between the top wall and bottom surfaces of side walls and connected at each end to the side walls whereby the slant and arcuate shape of the protective shield causes blows directed at the terminal box when mounted on the magnet with its arcuate front wall adjacent the outer edge of the magnet to glance off without mechanical damage to the box.

2. The terminal box of claim 1, wherein said front wall is of a greater thickness than the other walls of the box and tapers from wide to narrow in its direction away from the bottom surface.

3. The terminal box of claim 1, wherein said walls of terminal box are integrally cast out of steel, said walls further define a sealable enclosure in which a service lead from a power source and the coil leads of said magnet can be electrically connected together in a moisture-proof environment.

4. The terminal box of claim 3, further including a walled divider in the shape of an "H" located midway between the side walls within said enclosure and extending from the front wall to the rear wall of the terminal box, said walled divider dividing the enclosure into four separate chambers.

5. The terminal box of claim 4, wherein the walls of said walled divider include conductor lead passages therethrough and place the four separate chambers in communication with one another.

6. The terminal box of claim 4, wherein said top wall has a U-shaped recessed opening positioned about the chambers defined by the space inside the parallel legs of the "H" walled divider for providing access to the chambers and has a pair of laterally spaced circular openings respectively spaced on opposite sides of the U-shaped opening and said circular openings disposed above the chambers on either side of the H-shaped walled divider for providing access to the chambers, and the terminal box further including a pair of covers releasably secured in the circular openings for sealing the openings and a cover releasably secured in the U-shaped opening for sealing the U-shaped opening.

7. A terminal box for mounting on a lifting magnet of the type having a casing with apertures in the top portion thereof for passing magnet coil leads therethrough, a power source with service leads, wherein the improvement comprises: an arcuate front wall extending upwardly from its bottom surface and slanting inwardly from the outer edge of its bottom surface as it extends upwardly; a pair of opposing side walls extending upwardly from their bottom surfaces and connected to the ends of the arcuate front wall, said side walls slanting inwardly toward one another as they extend upwardly to the same height as the front wall, said side walls and front walls defining a protective shield; a top wall recessed below the upper edge of the protective shield and extending laterally from the concave side of the protective shield a predetermined distance; a rear wall extending between the top wall and bottom surfaces of the other walls and connected at either end to the side walls to complete a box structure defining a hollow chamber for electrically joining the coil and service leads together; and said bottom surfaces of the front, sides and rear walls defining a mounting surface having openings therethrough coinciding with the apertures in the casing of the magnet and having one edge of the mounting surface substantially adjacent the outer edge of the magnet when the terminal box is mounted on the magnet.

8. The terminal box of claim 7, further including walled means, received within said hollow chamber and connected to the walls of the box structure for dividing the hollow chamber into three individually sealable chambers, one a service lead chamber and the other two coil lead chambers.

9. The terminal box of claim 8, wherein the walls of said dividing means include conductor lead passages therethrough for placing the individually sealable chambers in communication with one another, and said terminal box further including means, threadably received within said conductor lead passages for sealing the passages between chambers.

10. The terminal box of claim 9, wherein the service lead chamber is divided into two parts, one part initially receiving the service leads and open to the outside atmosphere and the other part sealed from said one part by said sealing means, said other part being in communication with coil lead chambers.

11. The terminal box of claim 10, further including a terminal stud extending through the conductor lead passage between the other part of the service lead chamber and a coil lead chamber, an insulating bushing disposed within said conductor lead passage to surround the terminal stud and hold it in place, washers and terminal nuts fixedly securing the terminal stud in the conductor lead passage, and a wire terminating fastening means attached to each end of the terminal stud for providing a connection to the terminal stud for the coil and service leads.

12. The terminal box of claim 11, wherein the insulator bushing is silicone rubber.

13. The terminal box of claim 9, wherein said sealing means received within said conductor lead passages in the wall dividing the service lead chamber into two parts is a gland nut.

14. The terminal box of claim 9, further including a high temperature nylon gland nut surrounding the coil lead in the coil chamber sealing the coil lead chamber from the inside of the magnet casing, said gland nut preventing inadvertent cutting and grounding of coil leads when bending the coil leads in the coil cavity for electrical connection to the terminal stud.

15. The terminal box of claim 8, wherein said top wall includes openings for gaining access to the service and coil lead chambers, and said terminal box further including means releasably and sealably received within said access openings for sealing said chambers.

16. The terminal box of claim 15, wherein said access openings are a pair of circular threaded openings, one disposed over each coil lead chamber and a U-shaped recess opening in the top wall disposed over the service lead chamber and wherein said sealing means is a pair of tapered pipe plugs threaded into the pair of circular threaded holes on the top wall of the terminal box and a U-shaped cover plate and corresponding sealing gasket fixedly attached in the recessed U-shaped opening on the top wall over the service lead chamber providing access to both parts of the service lead chamber.

17. The terminal box of claim 8, wherein the protective shield extending along the front and sides of the terminal box and all of the walls including the walled dividing means are integrally cast, said arcuate and slanting front wall tapering from wide to narrow in a direction away from its bottom surface and forming a curved surface at its junction with the slanting side walls so that an object hitting the arcuate and slanting protective shield is likely to glance off of the terminal box without mechanical damage thereto.

* * * * *